US009810435B2

(12) United States Patent
Gulkanat

(10) Patent No.: US 9,810,435 B2
(45) Date of Patent: Nov. 7, 2017

(54) GAS FIRED INFRARED BURNER WITH AUXILIARY FLAME ARRANGEMENT

(71) Applicant: Bektas C. Gulkanat, Charlotte, NC (US)

(72) Inventor: Bektas C. Gulkanat, Charlotte, NC (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 495 days.

(21) Appl. No.: 14/475,624

(22) Filed: Sep. 3, 2014

(65) Prior Publication Data

US 2015/0101591 A1 Apr. 16, 2015

Related U.S. Application Data

(60) Provisional application No. 61/890,533, filed on Oct. 14, 2013.

(51) Int. Cl.

| | |
|---|---|
| ***F24C 3/00*** | (2006.01) |
| ***F24C 3/06*** | (2006.01) |
| ***F24C 3/10*** | (2006.01) |
| ***F23D 14/14*** | (2006.01) |
| *F24C 3/12* | (2006.01) |

(52) U.S. Cl.
CPC ..... *F24C 3/06* (2013.01); *F23D 14/145* (2013.01); *F24C 3/10* (2013.01); *F24C 3/12* (2013.01)

(58) Field of Classification Search
CPC ..... F23D 14/14; F23D 14/145
See application file for complete search history.

(56) References Cited

U.S. PATENT DOCUMENTS

| | | | | |
|---|---|---|---|---|
| 4,724,823 A * | 2/1988 | Simpson | ..... | A47J 37/0682 126/39 D |
| 4,799,879 A | 1/1989 | Laspeyres | | |
| 5,816,235 A | 10/1998 | Kim et al. | | |
| 6,114,666 A | 9/2000 | Best | | |
| 6,971,871 B2 | 12/2005 | Ahmady | | |

(Continued)

FOREIGN PATENT DOCUMENTS

DE 3409334 A1 * 9/1985 ..... F24C 3/067

OTHER PUBLICATIONS

Rieck English Translation.*

*Primary Examiner* — Jason Lau
(74) *Attorney, Agent, or Firm* — Thompson Hine LLP

(57) ABSTRACT

A gas fired infrared burner includes a burner body with a primary inlet for gaseous fuel and air, the burner body defining a primary premixing chamber for receiving gaseous fuel and air from the primary inlet. An emitter arrangement is configured and positioned such that gaseous fuel and air flows through the emitter arrangement to be combusted at an external surface of the emitter arrangement. The burner body includes an auxiliary inlet for gaseous fuel and air, and the burner body defines an auxiliary premixing chamber for receiving gaseous fuel and air from the auxiliary inlet. The emitter arrangement includes an auxiliary emitter segment that receives gaseous fuel and air from the auxiliary premixing chamber such that combustible gases emitted from the auxiliary emitter segment can be ignited even when no combustible gases are being emitted from portions of the emitter arrangement that are fed from the primary premixing chamber.

19 Claims, 6 Drawing Sheets

(56) References Cited

U.S. PATENT DOCUMENTS

| | | | | |
|---|---|---|---|---|
| 2006/0048724 | A1* | 3/2006 | Peart | F23D 14/26 122/14.2 |
| 2008/0096147 | A1* | 4/2008 | Newsom | F23N 1/00 431/12 |
| 2011/0111356 | A1 | 5/2011 | Claerbout et al. | |
| 2011/0117509 | A1 | 5/2011 | Claerbout et al. | |
| 2012/0178034 | A1* | 7/2012 | French | A47J 37/0713 431/328 |

* cited by examiner

GAS FIRED INFRARED BURNER WITH AUXILIARY FLAME ARRANGEMENT

CROSS-REFERENCES

This application claims the benefit of U.S. Provisional Application Ser. No. 61/890,533, filed Oct. 14, 2013, which is incorporated herein by reference.

TECHNICAL FIELD

The present disclosure relates to gas fired infrared burners and, more particularly, to an ignition control arrangement for such burners and burner systems.

BACKGROUND

Gas fired infrared burners are well known. The use of such burners in cooking equipment is also known. One cooking equipment arrangement incorporates one or more gas fired infrared burners into a burner box. The infrared burners are fed by a venturi system that mixes air with the gaseous fuel. The infrared burners in the burner box do not generally require, and are not provided with any flow of secondary air.

One issue with the above arrangement is the difficulty in using a pilot burner in connection with the arrangement. Specifically, a traditional pilot cannot be placed within the burner box that houses the infrared burners because a traditional pilot requires secondary air to remain lit. This issue has been addressed by placing the traditional pilot just outside the burner box and adjacent to a small opening through the wall of the burner box. When the burners with the burner box are to be lit, gas is fed to the burners and fills the burner box until some of the gas exits the small opening, which causes ignition of the gases in the burner box and thus the burners themselves. Such systems have a somewhat delayed ignition (due to the time required for gases to fill the burner box) and back firing of the burner due to the delayed ignition.

Therefore, it would be desirable to provide an improved ignition arrangement for gas fired infrared burners.

SUMMARY

In one aspect, a gas fired infrared burner includes a burner body and an emitter arrangement. The burner body includes a primary inlet for gaseous fuel and air, the burner body defining a primary premixing chamber for receiving gaseous fuel and air from the primary inlet. The emitter arrangement is configured and positioned such that gaseous fuel and air flows through the emitter arrangement in a manner to be combusted at an external surface of the emitter arrangement. The burner body further includes an auxiliary inlet for gaseous fuel and air, and the burner body further defines an auxiliary premixing chamber for receiving gaseous fuel and air from the auxiliary inlet. The emitter arrangement includes an auxiliary emitter segment that receives gaseous fuel and air from the auxiliary premixing chamber such that combustible gases emitted from the auxiliary emitter segment can be ignited even when no combustible gases are being emitted from portions of the emitter arrangement that are fed from the primary premixing chamber.

In one implementation of the burner, the primary premixing chamber and the auxiliary premixing chamber are sealed from each other by an internal wall structure of the burner body.

In one implementation of the burner of either of the two preceding paragraphs, the emitter arrangement defines a total combustion surface area that is made up of a primary combustion surface area fed by the primary premixing chamber and an auxiliary combustion surface area fed by the auxiliary premixing chamber, and the auxiliary emitter segment defines the auxiliary combustion surface area, and the auxiliary combustion surface area is less than twenty-five percent of the primary combustion surface area.

In one implementation of the burner of any of the three preceding paragraphs, the auxiliary combustion surface area is less than fifteen percent of the primary combustion surface area.

In one implementation of the burner of any of the four preceding paragraphs, the burner body is elongated and includes an inlet end in which both the primary inlet and the auxiliary inlet are located.

In one implementation of the burner of any of the five preceding paragraphs, the auxiliary emitter segment is located adjacent the inlet end of the burner body.

In one implementation of the burner of any of the six preceding paragraphs, the burner further includes: a primary venturi feed connected to the primary inlet, and an auxiliary venturi feed connected to the auxiliary inlet.

In one implementation of the burner of any of the seven preceding paragraphs, a flow area of the auxiliary inlet is no more than fifty percent of a flow area of the primary inlet.

In one implementation of the burner of any of the eight preceding paragraphs, a flow area of the auxiliary inlet is no more than thirty percent of a flow area of the primary inlet.

In one implementation of the burner of any of the nine preceding paragraphs, the emitter arrangement is of ceramic or metal construction.

In one implementation of the burner of any of the ten preceding paragraphs, the emitter arrangement is formed by one or more emitter plates comprised of ceramic and/or metal.

In one implementation of the burner of any of the eleven preceding paragraphs, the emitter arrangement defines a total combustion surface area that is made up of a primary combustion surface area fed by the primary premixing chamber and an auxiliary combustion surface area fed by the auxiliary premixing chamber, the emitter arrangement including a common emitter plate that defines both (i) at least part of the primary combustion surface area and (2) at least part of the auxiliary combustion surface area.

In one implementation of the burner of the preceding paragraph, the common emitter plate defines an entirety of the auxiliary combustion surface area.

In another aspect, a heating arrangement includes a burner box and at least one gas fired infrared burner positioned within the burner box. The infrared burner includes a burner body including a primary inlet for gaseous fuel and air and an auxiliary inlet for gaseous fuel and air. The infrared burner includes an emitter arrangement mounted on the burner body and through which mixed gaseous fuel and air flow in a manner to be combusted at an external surface of the emitter arrangement, wherein the emitter arrangement includes a primary combustion surface area fluidly connected to receive gaseous fuel and air from the primary inlet and an auxiliary combustion surface area fluidly connected to receive gaseous fuel and air from the auxiliary inlet.

In one implementation of the heating arrangement of the preceding paragraph, the heating arrangement further includes: a pilot valve for controlling gas flow into the auxiliary inlet; a burner valve for controlling gas flow into the primary inlet; an igniter within the burner box and positioned for igniting gases emitted from the auxiliary combustion surface area; and a flame sensor within the burner box for detecting combustion of gases at the auxiliary combustion surface area.

In one implementation of the heating arrangement of the preceding paragraph, the heating arrangement further includes a control arrangement that operates to prevent gas flow through the burner valve in the absence of flame detection by the flame sensor.

In one implementation of the heating arrangement of the preceding paragraph, the burner box includes multiple infrared burners and each infrared burner includes a respective pilot valve, burner valve, igniter and flame sensor.

In one implementation of the heating arrangement of any of the four preceding paragraphs, the heating arrangement further includes a cooking surface positioned above the infrared burner for being heated by the infrared burner.

In another aspect, a method is provided for operating a gas fired infrared burner including a burner body and an emitter arrangement. The method involves: providing a primary gaseous fuel path into the burner body and to a primary combustion surface of the emitter arrangement; providing an auxiliary gaseous fuel path into the burner body and to an auxiliary combustion surface of the emitter arrangement; flowing gaseous fuel along the auxiliary gaseous fuel path and combusting the gaseous fuel at the auxiliary combustion surface; flowing gaseous fuel along the primary gaseous fuel path to the primary combustion surface; and utilizing flame from combustion at the auxiliary combustion surface as a pilot to ignite gaseous fuel emitted at the primary combustion surface.

In one implementation of the method of the preceding paragraph, the infrared burner is positioned within a burner box; and combustion at the auxiliary combustion surface utilizes primary air from a venturi feed but does not require secondary air.

In one implementation of the method of either of the two preceding paragraphs, an igniter is positioned within the burner box and is used to ignite gaseous fuel at the auxiliary combustion surface; a flame detector is positioned within the burner box for detecting combustion of gases at the auxiliary surface area; and a control arrangement prevents flow of gaseous fuel along the primary gaseous fuel path when the flame detector does not detect combustion at the auxiliary surface area.

In one implementation of the method of the preceding paragraph, the control arrangement includes a burner valve that controls feed of gaseous fuel along the primary gaseous fuel path, a temperature control knob and a temperature sensor within the burner box.

In one implementation of the method of any of the four preceding paragraphs, the heating arrangement is associated with a food cooking device.

In one implementation of the method of the preceding paragraph, the food cooking device includes a cooking surface that is located to be heated by the infrared burner.

The details of one or more embodiments are set forth in the accompanying drawings and the description below. Other features, objects, and advantages will be apparent from the description and drawings, and from the claims.

DETAILED DESCRIPTION

Figure 1:
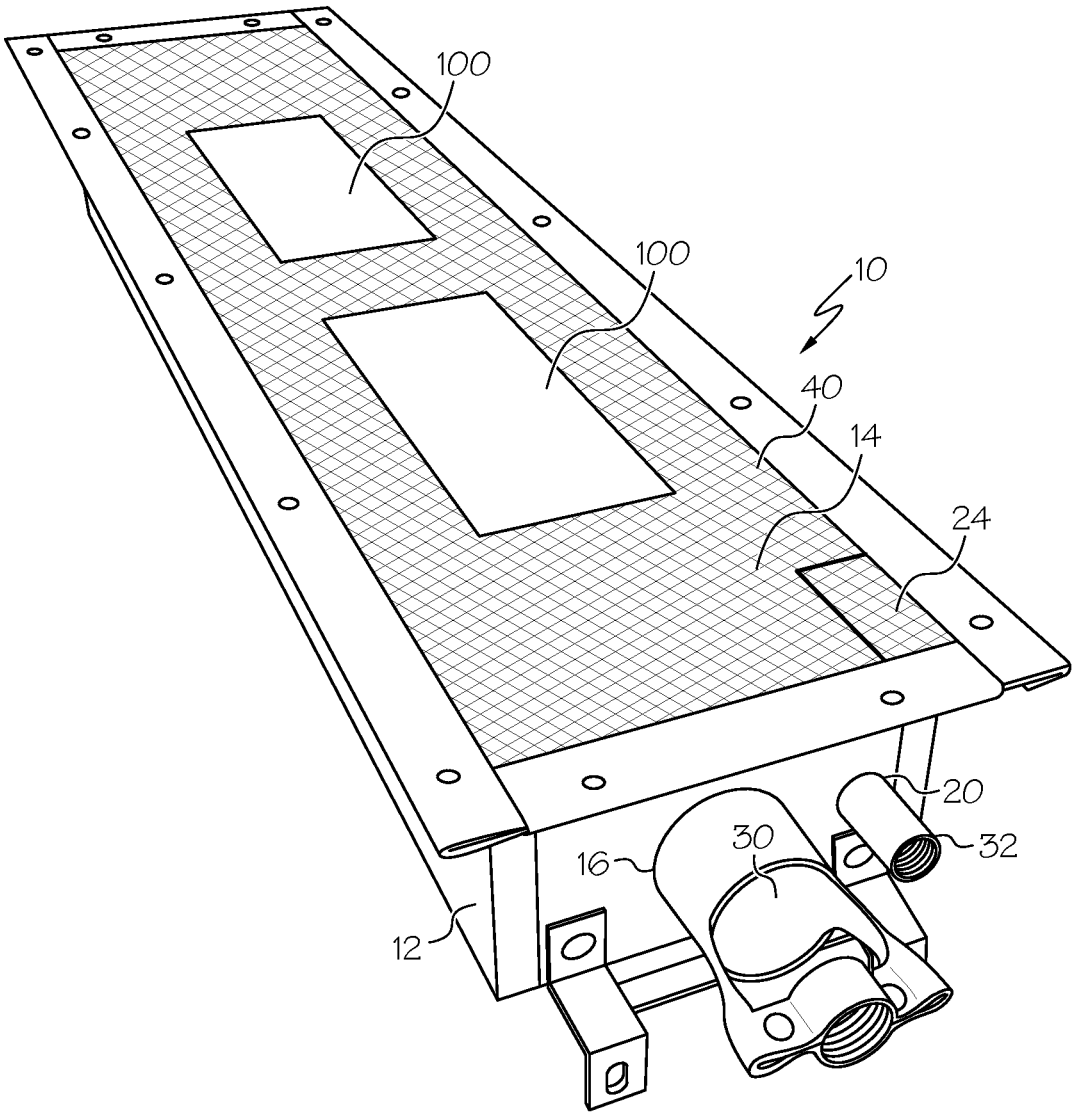
FIG. 1 is a perspective view of one embodiment of a burner.

Referring to FIGS. 1-5, one embodiment of a gas fired infrared burner 10 with auxiliary flame arrangement is shown. The gas fired infrared burner 10 includes a burner body 12 and an emitter arrangement 14. In the illustrated embodiment, the burner body is of elongated box-shaped configuration, but other variations are possible. The burner body includes a primary inlet 16 for gaseous fuel and air, and the primary inlet leads to a primary premixing chamber 18 defined within the burner body for receiving gaseous fuel and air from the primary inlet. The emitter arrangement 14 is configured and positioned such that gaseous fuel and air flows through the emitter arrangement in a manner to be combusted at an external surface of the emitter arrangement. The burner body further includes an auxiliary inlet 20 for gaseous fuel and air, and the burner body further defines an auxiliary premixing chamber 22 for receiving gaseous fuel and air from the auxiliary inlet. The primary inlet and auxiliary inlet are located in a common end of the burner body, thought other variations are possible. The emitter arrangement includes an auxiliary emitter segment 24 that receives gaseous fuel and air from the auxiliary premixing chamber 22 such that combustible gases emitted from the auxiliary emitter segment can be ignited even when no combustible gases are being emitted from portions of the emitter arrangement that are fed from the primary premixing chamber.

As shown, the primary premixing chamber and the auxiliary premixing chamber are sealed from each other so that gasses in the primary premixing chamber and gases and in the auxiliary premixing chamber do not mix and are therefore pass through the emitter separately. In the illustrated embodiment an internal wall structure 26 of the burner body provides the separation and may include associate gasket material 28 for seating against the bottom of the emitter. As seen in FIG. 1, separate venturi members 30 and 32 may be associated with the respective inlets 16 and 20, with the primary venturi 30 of larger size than the auxiliary venturi 32. In this regard, because the auxiliary premixing chamber 22 and auxiliary emitter segment are relatively small as compared to the total primary mixing chamber and total emitter size respectively, a flow area of the auxiliary inlet may be no more than fifty percent (e.g., no more than thirty percent or in some cases no more than twenty-five percent) of a flow area of the primary inlet. When both venturis are feeding gas, the flow of gaseous fuel through the auxiliary inlet will also be similarly smaller relative to that of the primary inlet (e.g., less than twenty percent of less than fifteen percent or even less than ten percent as compared to the amount of gaseous fuel delivered through the primary inlet).

The emitter arrangement 14 defines a total combustion surface area that is made up of a primary combustion surface area fed by the premixing chamber 18 and an auxiliary combustion surface area fed by the auxiliary premixing chamber 22. The auxiliary emitter segment 24 defines the auxiliary combustion surface area. As shown, the auxiliary combustion surface area is less than twenty-five percent (e.g., less than twenty present or less than fifteen percent or less than ten present or even less than five percent) of the primary combustion surface area. In this regard, portions 100 of the emitter arrangement may be blocked off to prevent combustion in those areas, in which case such areas do not form part of the primary combustion surface area.

In the illustrated embodiment, the auxiliary emitter segment 24 is located adjacent the inlet end of the burner body. Thus, the auxiliary premixing chamber 22 is also located near inlet end of the burner body. In the illustrated embodiment the primary premixing chamber includes a tubular pipe 34 and baffle plate 36 with side openings 38 that aid in mixing the gaseous fuel and air. However, variations are possible, including burners in which such structures are not present.

Figure 2:
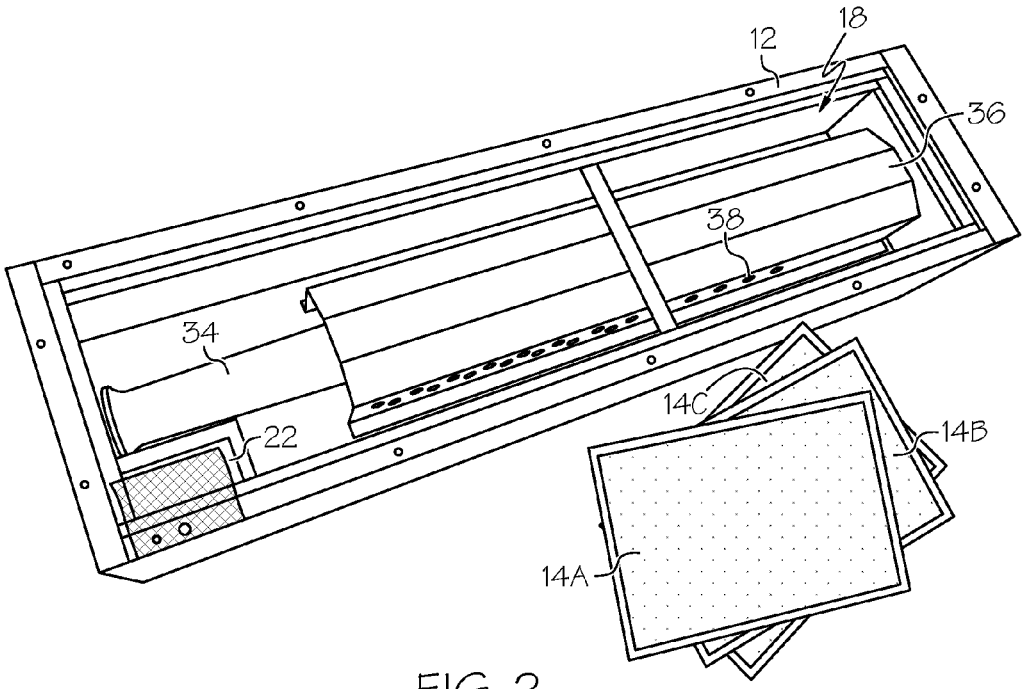
FIGS. 2 and 3 are perspective views of the burner of FIG. 1 with emitter plates removed.
Figure 3:
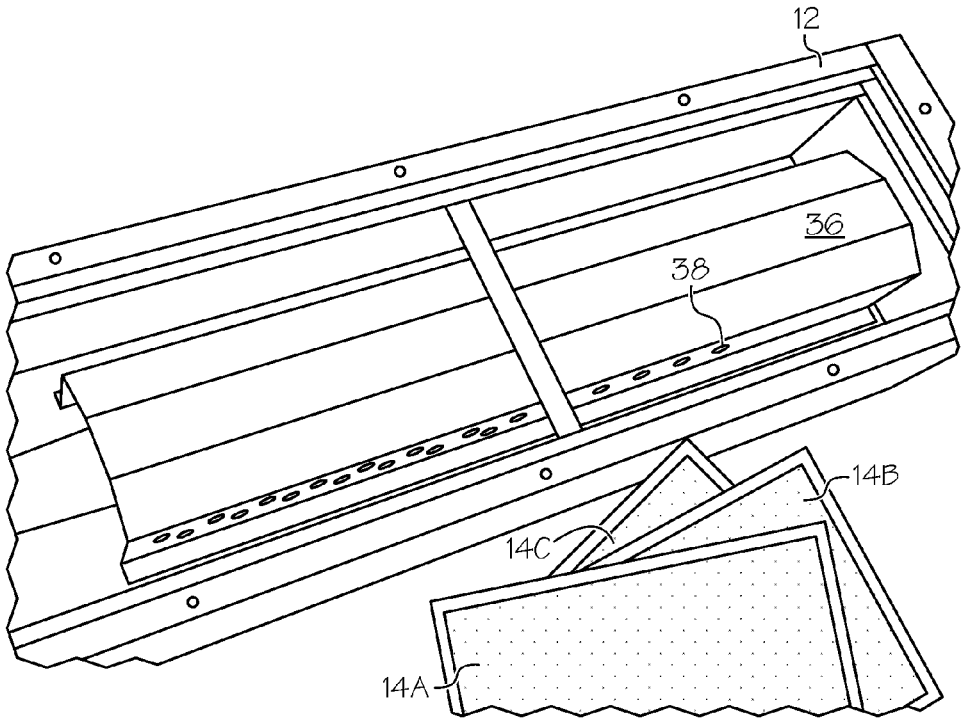
Figure 4:
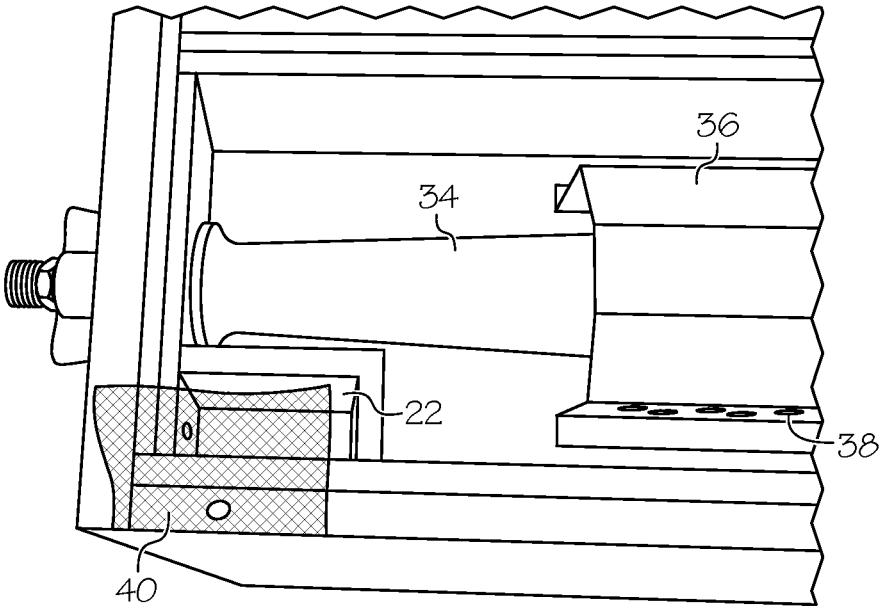
FIGS. 4 and 5 are enlarged perspective views of the auxiliary premixing chamber of the burner of FIG. 1.
Figure 5:
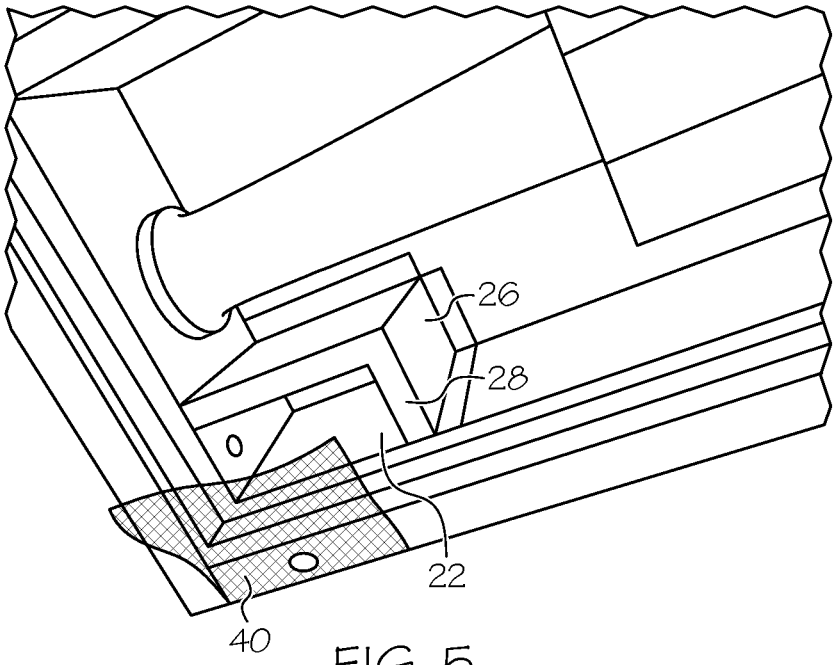

As shown in FIGS. 2 and 3, the emitter arrangement 14 of the illustrated embodiment is made up of three distinct emitter plates 14A-14C. However, the emitter arrangement could be of one, two or four or more plates. Likewise, the emitter arrangement could be of a configuration that is other than a plate or plates. In one embodiment, the emitter is a ceramic type with pores or openings through which gases pass. However, other materials could be used, such as metal. A wire mesh screen 40 overlays the emitter plates and helps ground the flame at the combustion surface of the emitter plates. The emitter arrangement includes a common emitter plate (e.g., emitter plate 14A) that defines both (i) part of the primary combustion surface area and (2) part or all of the auxiliary combustion surface area, where the primary portion of the plate is fed by the primary premixing chamber and the auxiliary portion is fed by the auxiliary premixing chamber. However, other emitter arrangements are possible including having a separate emitter component for the auxiliary combustion surface area only.

Figure 6:
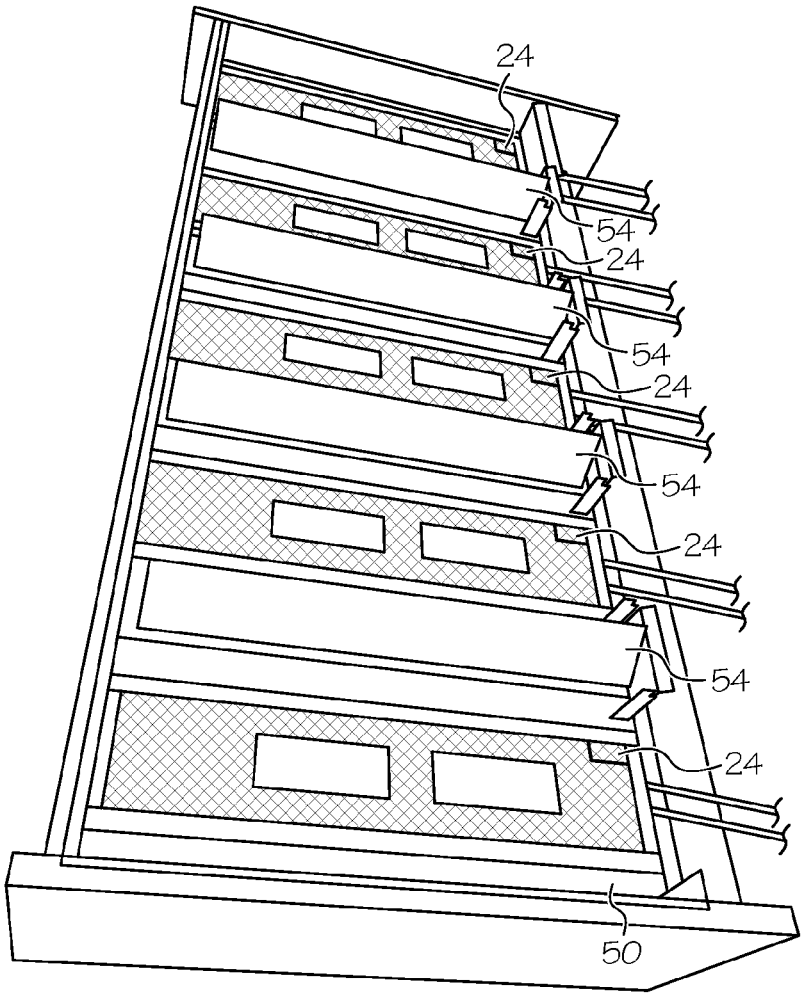
FIGS. 6 and 7 show one embodiment of heating arrangement of a cooking device.
Figure 7:
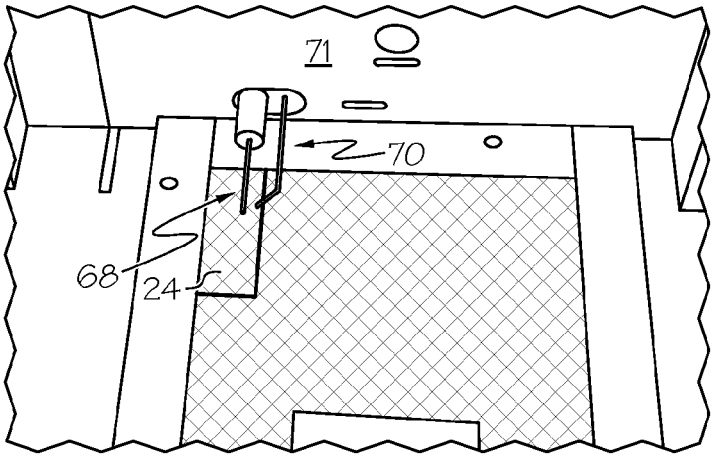
Figure 8:
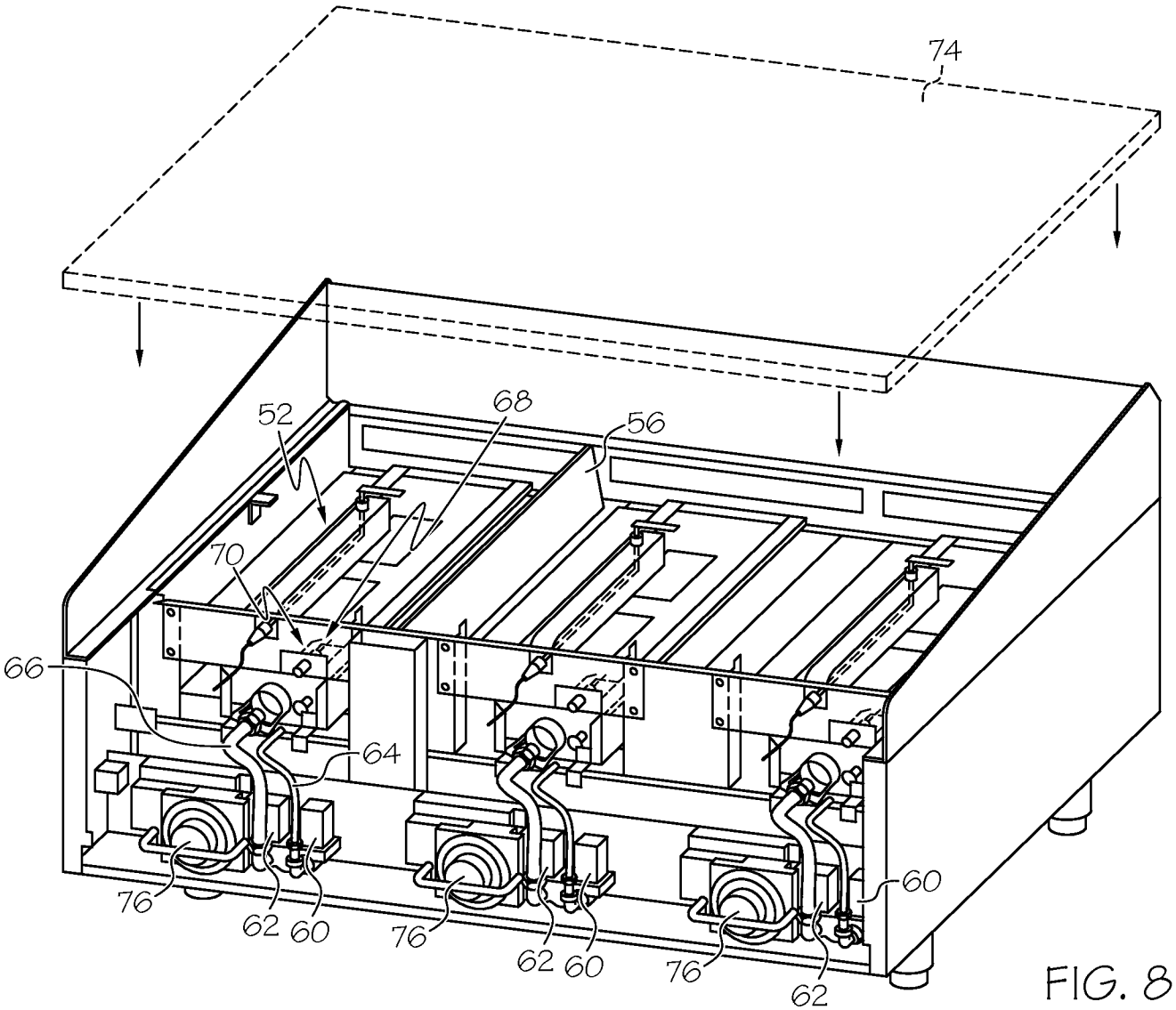
FIG. 8 shows another embodiment of a heating arrangement of a cooking device.

Referring now to FIGS. 6-8, a heating arrangement includes a burner box 50 (FIG. 6) or 52 (FIG. 8) and at least one gas fired infrared burner is positioned within the burner box (e.g., five in the case of FIG. 6 and three in the case of FIG. 8). The burner box may be sub-divided into compartments (e.g., by wall members 54 or 56) to house each burner. A primary combustion surface of each burner is fluidly connected to receive gaseous fuel and air from the primary inlet of that burner and an auxiliary combustion surface area of each burner is fluidly connected to receive gaseous fuel and air from the auxiliary inlet of that burner. A pilot valve 60 (e.g., solenoid type) controls gas flow (e.g., along tube/pipe feed 64) into the auxiliary inlet of each burner, while a burner valve 62 (e.g., solenoid type) controls gas flow (e.g., along tube/pipe feed 66) into the primary inlet. An igniter 68 (e.g., spark igniter mounted through a wall 71 of the burner box) is located within the burner box and positioned for igniting gases emitted from the auxiliary combustion surface area. Such positioning may be immediately above the auxiliary combustion surface area. A flame sensor 70 (e.g., mounted through the wall 71 of the burner box) is positioned within the burner box for detecting combustion of gases at the auxiliary combustion surface area. A control arrangement for each burner operates to prevent gas flow through the burner valve 62 in the absence of flame detection by the flame sensor 70. Referring to FIG. 8, the heating arrangement may be that of a cooking device, such as a type having a cooking surface 74 positioned above the infrared burner for being heated by the infrared burner. For example, the cooking surface may be that of a griddle plate or charbroiler grate.

Figure 9:
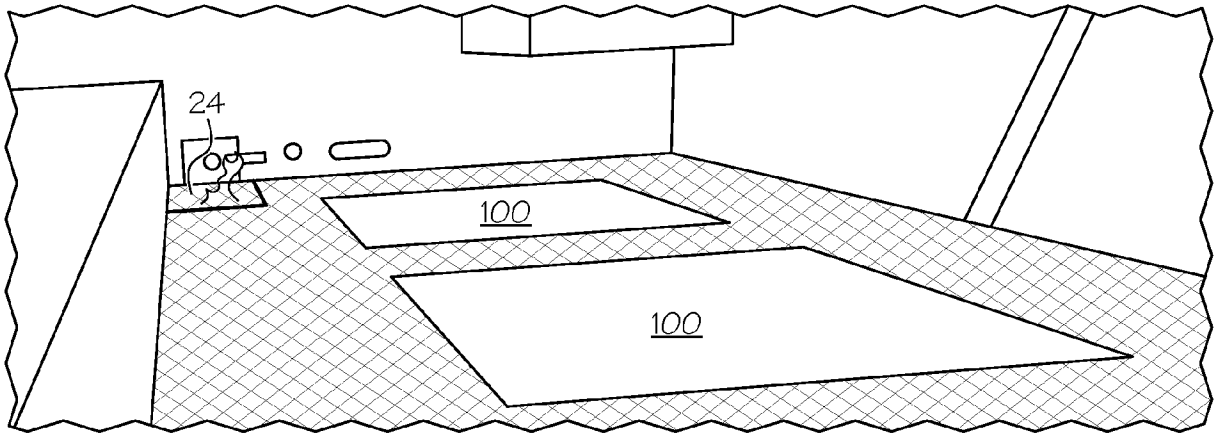
FIG. 9 depicts the surface of the burner of FIG. 1 with only the auxiliary combustion surface in burn.
Figure 10:
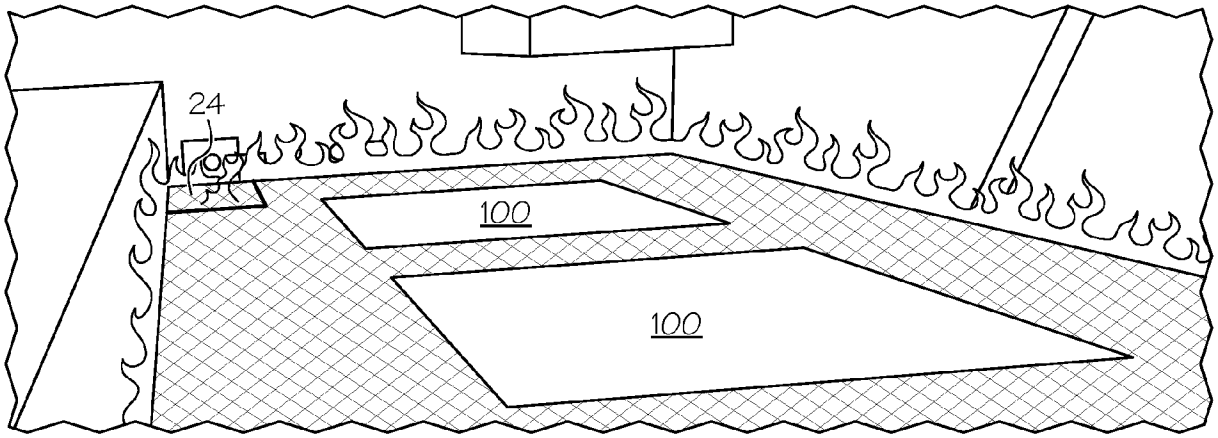
FIG. 10 depicts the surface of the burner of FIG. 1 with both the primary and the auxiliary combustion surfaces in burn.

The auxiliary combustion surface provided in each burner facilitates use of such surface portion as a pilot for igniting the primary combustion surface of the burner. Thus, a method is provided for operating a gas fired infrared burner including a burner body and an emitter arrangement, where the method involves: providing a primary gaseous fuel path into the burner body and to a primary combustion surface of the emitter arrangement; providing an auxiliary gaseous fuel path into the burner body and to an auxiliary combustion surface of the emitter arrangement; flowing gaseous fuel along the auxiliary gaseous fuel path and combusting the gaseous fuel at the auxiliary combustion surface; flowing gaseous fuel along the primary gaseous fuel path to the primary combustion surface; and utilizing flame from combustion at the auxiliary combustion surface as a pilot to ignite gaseous fuel emitted at the primary combustion surface. Notably, combustion at the auxiliary combustion surface will continue to take place even during combustion at the primary combustion surface, without being extinguished due to lack of secondary air. FIG. 9 shows a view with only the auxiliary combustion surface area in a state of burn, while FIG. 10 shows a view with both the primary combustion surface area and the auxiliary combustion surface area in a state of burn.

An igniter may be positioned within the burner box and used to ignite gaseous fuel at the auxiliary combustion surface; a flame detector may be positioned within the burner box for detecting combustion of gases at the auxiliary surface area; and a control arrangement can then operate to prevent flow of gaseous fuel along the primary gaseous fuel path when the flame detector does not detect combustion at the auxiliary surface area. The control arrangement may include the burner valve 62 and a temperature control knob 76 and the temperature sensor 70 within the burner box.

It is to be clearly understood that the above description is intended by way of illustration and example only, is not intended to be taken by way of limitation, and that other changes and modifications are possible.

What is claimed is:

1. A gas fired infrared burner, comprising:

a burner body including a primary inlet for gaseous fuel and air, the burner body defining a primary premixing chamber for receiving gaseous fuel and air from the primary inlet;

an emitter arrangement comprising a material with a plurality pores or openings through which gaseous fuel and air flow in order to be combusted at an external surface of the emitter arrangement;

wherein the burner body further includes an auxiliary inlet for gaseous fuel and air, the burner body further defines an auxiliary premixing chamber for receiving gaseous fuel and air from the auxiliary inlet, and the emitter arrangement includes an auxiliary emitter segment that receives gaseous fuel and air from the auxiliary premixing chamber such that gaseous fuel and air of the auxiliary premixing chamber flows through pores or openings of the auxiliary emitter segment in order to be combusted at an auxiliary portion of the external surface formed by the auxiliary emitter segment, wherein gaseous fuel and air flowing through pores or openings of the auxiliary emitter segment can be ignited even when no combustible gases are being emitted from primary portions of the external surface of the emitter arrangement that are fed from the primary premixing chamber;

wherein flame produced by combustion at both the primary portions of the external surface and the auxiliary portion of the external surface is grounded at the external surface;

wherein the primary premixing chamber and the auxiliary premixing chamber are sealed from each other by an internal wall structure of the burner body, wherein the internal wall structure has a top side that terminates at an underside of the emitter arrangement.

2. The infrared burner of claim 1 wherein the emitter arrangement defines a total combustion surface area that is made up of a primary combustion surface area fed by the primary premixing chamber and an auxiliary combustion surface area fed by the auxiliary premixing chamber, and the auxiliary emitter segment defines the auxiliary combustion surface area, and the auxiliary combustion surface area is less than twenty-five percent of the primary combustion surface area.

3. The infrared burner of claim 2 wherein the auxiliary combustion surface area is less than fifteen percent of the primary combustion surface area.

4. The infrared burner of claim 1 wherein the burner body is elongated and includes an inlet end wall in which both the primary inlet and the auxiliary inlet are located.

5. The infrared burner of claim 1, further comprising:

a primary venturi feed connected to the primary inlet; and an auxiliary venturi feed connected to the auxiliary inlet.

6. The infrared burner of claim 5 wherein the auxiliary emitter segment is located adjacent the inlet end of the burner body.

7. The infrared burner of claim 1 wherein a flow area of the auxiliary inlet is no more than fifty percent of a flow area of the primary inlet.

8. The infrared burner of claim 1 wherein the emitter arrangement is of ceramic or metal construction.

9. The infrared burner of claim 1 wherein the emitter arrangement defines a total combustion surface area that is made up of a primary combustion surface area fed by the primary premixing chamber and an auxiliary combustion surface area fed by the auxiliary premixing chamber, the emitter arrangement including a common emitter plate that defines both (i) at least part of the primary combustion surface area and (2) at least part of the auxiliary combustion surface area.

10. The infrared burner of claim 9 wherein the common emitter plate defines an entirety of the auxiliary combustion surface area.

11. A heating arrangement, comprising:

a burner box;

at least one gas fired infrared burner positioned within the burner box, the infrared burner including:

a burner body including a primary inlet for gaseous fuel and air and an auxiliary inlet for gaseous fuel and air, wherein the primary inlet feeds to a primary chamber of the burner body and the auxiliary inlet feeds to an auxiliary chamber of the burner body;

an emitter arrangement mounted on the burner body and through which mixed gaseous fuel and air flow in a manner to be combusted at an external surface of the emitter arrangement, wherein the emitter arrangement includes a primary combustion surface area fluidly connected to receive gaseous fuel and air from the primary chamber and an auxiliary combustion surface area fluidly connected to receive gaseous fuel and air from the auxiliary chamber, wherein both the primary combustion surface area and the auxiliary combustion surface area are formed by a common emitter plate that extends over both the primary chamber, the auxiliary chamber and an internal wall dividing the primary chamber from the auxiliary chamber, wherein the primary chamber and the auxiliary chamber are sealed from each other by the internal wall and a top side of the internal wall terminates at an underside of the emitter arrangement.

12. The arrangement of claim 11, further comprising:

a pilot valve for controlling gas flow into the auxiliary inlet;

a burner valve for controlling gas flow into the primary inlet;

an igniter within the burner box and positioned for igniting gases emitted from the auxiliary combustion surface area;

a flame sensor within the burner box for detecting combustion of gases at the auxiliary combustion surface area.

13. The arrangement of claim 12, further comprising:

a control arrangement that operates to prevent gas flow through the burner valve in the absence of flame detection by the flame sensor.

14. The arrangement of claim 13 wherein the burner box includes multiple infrared burners and each infrared burner includes a respective pilot valve, burner valve, igniter and flame sensor.

15. The arrangement of claim 13, further comprising:

a cooking surface positioned above the infrared burner for being heated by the infrared burner.

16. A method of operating a gas fired infrared burner including a burner body and an emitter arrangement, the method comprising:

providing a primary gaseous fuel path into a primary chamber of the burner body and then through multiple pores or openings to a primary combustion surface of the emitter arrangement;

providing an auxiliary gaseous fuel path into an auxiliary chamber of the burner body and then through multiple pores or openings to an auxiliary combustion surface of the emitter arrangement;

flowing gaseous fuel along the auxiliary gaseous fuel path and combusting the gaseous fuel at the auxiliary combustion surface with resulting flame grounded at the auxiliary combustion surface;

flowing gaseous fuel along the primary gaseous fuel path to the primary combustion surface; and utilizing flame from combustion at the auxiliary combustion surface as a pilot to ignite gaseous fuel emitted at the primary combustion surface;

wherein the primary chamber and the auxiliary chamber are sealed from each other by a wall within the burner body and a top side of the wall terminates at an underside of the emitter arrangement.

17. The method of claim 16 wherein:

the infrared burner is positioned within a burner box;

combustion at the auxiliary combustion surface utilizes primary air from a venturi feed but does not require secondary air.

18. The method of claim 17 wherein:

an igniter is positioned within the burner box and is used to ignite gaseous fuel at the auxiliary combustion surface;

a flame detector is positioned within the burner box for detecting combustion of gases at the auxiliary surface area;

a control arrangement prevents flow of gaseous fuel along the primary gaseous fuel path when the flame detector does not detect combustion at the auxiliary surface area.

19. The method of claim 18 wherein:

the control arrangement includes a burner valve that controls feed of gaseous fuel along the primary gaseous fuel path, a temperature control knob and a temperature sensor within the burner box.

* * * * *